US009316234B2

(12) United States Patent
Lange

(10) Patent No.: US 9,316,234 B2
(45) Date of Patent: Apr. 19, 2016

(54) ROTOR DISK FOR A TURBO MACHINE

(75) Inventor: Christoph Lange, Cologne (DE)

(73) Assignee: MAN Diesel & Turbo SE, Augsburg (DE)

( * ) Notice: Subject to any disclaimer, the term of this patent is extended or adjusted under 35 U.S.C. 154(b) by 1091 days.

(21) Appl. No.: 13/382,111

(22) PCT Filed: Jan. 25, 2010

(86) PCT No.: PCT/DE2010/050002

§ 371 (c)(1),
(2), (4) Date: Mar. 19, 2012

(87) PCT Pub. No.: WO2011/003409

PCT Pub. Date: Jan. 13, 2011

(65) Prior Publication Data

US 2012/0189373 A1 Jul. 26, 2012

(30) Foreign Application Priority Data

Jul. 4, 2009 (DE) ..... 10 2009 031 737

(51) Int. Cl.
*F04D 29/28* (2006.01)
*F01D 5/02* (2006.01)
*F04D 29/26* (2006.01)

(52) U.S. Cl.
CPC ..... *F04D 29/266* (2013.01); *F01D 5/025* (2013.01); *F04D 29/284* (2013.01); *F05D 2230/40* (2013.01); *F05D 2260/37* (2013.01); *Y10T 29/4932* (2015.01); *Y10T 403/10* (2015.01)

(58) Field of Classification Search
CPC ..... F01D 5/025; F01D 5/048; F04D 29/10; F04D 29/043; F04D 29/044; F04D 29/053; F04D 29/054; F04D 29/263; F04D 29/266; F04D 29/281; F04D 29/284; F04D 29/2222; F04D 29/2261; F04D 29/666; F05D 2230/40; F05D 2260/37; Y10T 403/10
See application file for complete search history.

(56) References Cited

U.S. PATENT DOCUMENTS

| | | | | |
|---|---|---|---|---|
| 4,053,261 | A | 10/1977 | Pennig | |
| 4,183,719 | A | 1/1980 | Bozung | |
| 4,697,987 | A | 10/1987 | Katayama et al. | |
| 6,202,301 | B1 | 3/2001 | Kawaguchi | |
| 7,001,155 | B2 * | 2/2006 | Cabrales et al. | 417/319 |
| 2005/0169764 | A1 | 8/2005 | Heyes et al. | |

FOREIGN PATENT DOCUMENTS

| | | |
|---|---|---|
| DE | 24 57 231 | 4/1976 |
| DE | 26 21 201 | 11/1977 |

(Continued)

OTHER PUBLICATIONS

Bartholoma, Klaus, machine translation of "Shaft fixing system for impeller wheel with radial thrust especially for turbocompressor has sleeve engaging with wheel hub and shaft spindle", retrieved Jul. 10, 2015.*

(Continued)

*Primary Examiner* — Edward Look
*Assistant Examiner* — Jason Davis
(74) *Attorney, Agent, or Firm* — Cozen O'Connor

(57) ABSTRACT

A rotor wheel for a turbomachine, particularly a radial turbomachine, having a rotor wheel face and a shrink collar adjoining the rotor wheel face for shrinking onto a rotor of the turbomachine and a circumferential groove between the rotor wheel face and the shrink collar.

15 Claims, 1 Drawing Sheet

(56) References Cited

FOREIGN PATENT DOCUMENTS

| | | | |
|---|---|---|---|
| DE | 297 02 119 | | 6/1997 |
| DE | 197 36 333 | | 3/1999 |
| DE | 101 01 165 | | 7/2002 |
| DE | 10 2005 037 739 | | 2/2007 |
| DE | 10 2007 012 641 | | 9/2008 |
| FR | 2819560 | A1 * | 7/2002 |
| GB | 770 004 | | 3/1957 |
| GB | 1191110 | | 10/1967 |
| JP | 63026701 | U * | 2/1988 |
| JP | 2000-054954 | | 2/2000 |
| JP | 2004-084816 | | 3/2004 |

OTHER PUBLICATIONS

Ichise, Mitsuo, machine translation of "High-Speed Rotator Mounting Structure", retrieved Jul. 16, 2015.*

* cited by examiner

ROTOR DISK FOR A TURBO MACHINE

CROSS REFERENCE TO RELATED APPLICATIONS

This is a U.S. national stage of application No. PCT/DE2010/050002, filed on 25 Jan. 2010. Priority is claimed on German Application No.: 10 2009 031 737.6 filed 4 Jul. 2009, the contents of which are incorporated here by reference.

BACKGROUND OF THE INVENTION

1. Field of the Invention

The invention is directed to a rotor wheel for a turbomachine, particularly a radial turbomachine, having a rotor wheel face and a shrink collar adjoining the rotor wheel face for shrinking onto a rotor of the turbomachine, a turbomachine having a rotor and a rotor wheel which is shrunk onto the rotor, and a method for producing a rotor wheel of this kind.

2. Description of Related Art

In turbomachines, rotor wheels convert energy of a fluid flowing through them and mechanical energy of a rotor supporting the rotor wheels into one another. In radial turbomachines, there is a flow through one or more rotor wheels transverse to the axis of rotation of the rotor for this purpose.

Rotor wheels are often axially secured to the rotor in frictional engagement by shrink fitting, i.e., an excess dimensioning of the outer diameter of the rotor relative to an inner diameter of the rotor wheel. To enlarge the contact surface of the shrink fit, known rotor wheels have shrink collars at one or both faces, i.e., axial extensions of the actual rotor wheel disk which have a smaller diameter. To ensure the safety-related axial fixing of the rotor wheels, the shrink collars can be additionally secured by shrink collar pins that penetrate aligned bore holes of the collar and rotor.

Owing to rotating speeds, which are very high at times, for example, in compressors, condensers, or turbines through which there is a flow of gas or vapor, the rotor wheels are acted upon by centrifugal forces which, among other things, lead to an expansion of the inner diameter of the rotor wheel and accordingly reduce the normal tensions applied by the shrink fit and, along with these normal tensions, the axially fixing frictional engagement. In so doing, shrink collar pins can be disadvantageously subjected to bending stresses or shear stresses and loaded by radial micromovements. Impaired operation, wear, or even failure of the turbomachine can result in both cases.

SUMMARY OF THE INVENTION

It is an object of the present invention to provide an improved turbomachine.

A rotor wheel according to the invention is provided for fastening to a rotor of a turbomachine, particularly a radial turbomachine such as a radial compressor or radial condenser. To this end, a shrink collar that is constructed integral with the rotor wheel disk in a preferred embodiment is provided on at least one rotor wheel face, preferably on the downstream rear side or rear wall of the rotor wheel disk carrying the rotor blades. The shrink collar is shrunk onto the rotor by expansion, particularly thermal expansion, of the inner diameter of a central bore hole of the shrink collar and/or compression of the associated outer diameter of the rotor.

According to one embodiment of the invention, a circumferential groove located on the radially outer side is formed between the face of the rotor wheel and the shrink collar connected to the rotor wheel. In particular, circumferential groove refers to a local reduction in cross section such as can be produced, for example, by cutting a groove into the rotating shrink collar by a lathe tool.

As a result of this material weakening, a partial decoupling is achieved between the rotor wheel disk, which is subject to higher centrifugal forces owing to its generally considerably larger outer diameter, and the shrink collar that fixes the rotor wheel axially in its entirety by its shrink fit. If the rotor wheel disk expands under the influence of centrifugal force, corresponding bending moments in particular which lead to an expansion of the shrink collar are not introduced into the circumferential groove, which acts to this extent in the manner of a joint, or are introduced into the shrink collar only to a decreased extent. In an advantageous manner, this can result in a smaller reduction in the axial contact length between the shrink collar and the rotor during operation because only a shorter portion of the shrink collar expands. In particular, this can allow shrink collar pins to be arranged in areas of the shrink collar which do not expand or which expand less than conventional shrink collars that proceed into the rotor wheel disk without grooves. Shrink collar pins of this kind are advantageously subjected to smaller loads in this way.

Accordingly, an intentional weakening of the rotor wheel by a local reduction in material in the form of radial necking between the rotor wheel disk and the shrink collar surprisingly leads to an improved shrink fit of the shrink collar in operation. These advantages outweigh the greater radial expansion of the rotor wheel disk, particularly in a sealing area, associated with the—to this extent—more flexible connection of the rotor wheel disk to the shrink collar and also the reduction in transmissible output.

The circumferential groove can be optimized in technical respects relating to manufacture, assembly and strength and also thermodynamically and/or dynamically. For example, a circumferential groove having side walls oriented substantially perpendicular to the axis of rotation of the rotor wheel can be produced in a particularly simple manner, e.g., by cutting. Similarly, rounded transitions or edges between side walls of the groove and the base of the groove and/or of the radially outer lateral surface of the shrink collar reduce the risk of injury during assembly as well as the notch effect along with the corresponding effect on strength, particularly fatigue strength and susceptibility to vibrations. A corresponding dimensioning of the groove width and/or groove depth influences the transfer of heat between the rotor wheel disk and shrink collar during operation and during shrink fitting as well as the rigidity of the connection of the rotor wheel disk to the shrink collar and, therefore, the vibration behavior and the expansion of the rotor wheel disk under centrifugal force and axial shear of the work fluid.

In one embodiment, the circumferential groove can be stepped radially one or more times, i.e., it can have a different outer diameter in some areas in direction of the axis of rotation of the rotor wheel. In addition or alternatively, it is also possible that the circumferential groove has a lateral surface which is inclined with respect to the axis of rotation and/or a curved lateral surface.

Especially good technical properties relating to manufacture, assembly and strength and thermodynamic and dynamic properties result from radial groove depths in a range between 0.1 times and 0.99 times, particularly 0.3 times and 0.7 times, preferably 0.5 times and 0.65 times, advantageously approximately 0.55 times, the radial height of the shrink collar, i.e., the maximum radial distance between the inner diameter and outer diameter of the shrink collar.

The circumferential groove is preferably arranged substantially directly at the face of the rotor wheel or rotor wheel disk in order to achieve a greater continuous axial fit of the remaining shrink collar.

BRIEF DESCRIPTION OF THE DRAWINGS

Further advantages and features follow from the subclaims and the embodiment example. The partially schematic drawings show:

DETAILED DESCRIPTION OF THE PREFERRED EMBODIMENTS

Figure 1:
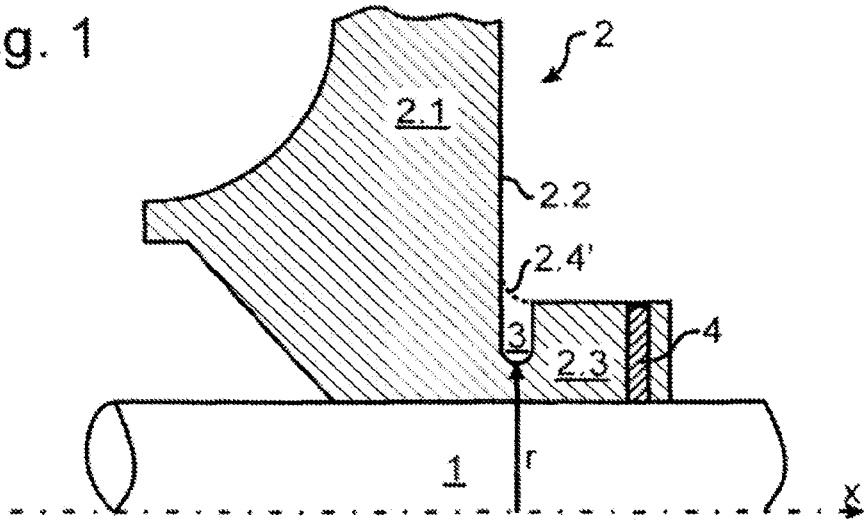
FIG. 1 is a portion of a rotor with a shrink-fitted rotor wheel according to one embodiment of the present invention in meridional and longitudinal section in the stationary state.

FIG. 1 is a view in meridional section showing a portion of a rotor 1 of a radial compressor to which a rotor wheel 2 is fastened. This rotor wheel 2 has a rotor wheel disk 2.1 and a shrink collar 2.3 integrally formed with the latter and is arranged at the downstream rear side 2.2 of the rotor wheel disk 2.1 remote of the rotor blades.

The rotor wheel 2 has a continuous cylindrical central bore hole. The nominal dimensions and tolerance dimensions of the inner diameter of this central bore hole are selected so as to be smaller than the nominal dimensions and tolerance dimensions of the outer diameter of the rotor in this area in such a way that a sufficient shrink fit which secures the rotor wheel 2 to the rotor 1 in a frictional engagement in axial direction x also results at operating temperatures. Further, a plurality of, e.g., three to five, shrink collar pins 4 are inserted into through-holes in the shrink collar 2.3 which are distributed around the circumference in a substantially uniform manner and, accordingly, into aligned blind holes in the rotor 1 and accordingly secure the axial position of the rotor wheel 2 on the rotor 1.

The outer contour of a conventional rotor wheel is shown in dashed lines. The rear wall of the rotor wheel disk passes into the shrink collar with a radius 2.4'. When a rotor wheel of this kind is acted upon by an operating rotational speed Ω (see FIG. 2), the centrifugal forces expand the rotor wheel radially. In so doing, the rotor wheel disk, which is loaded by centrifugal force to a greater extent due to its larger outer diameter, exerts a tilting moment or bending moment on the shrink collar which, in addition to the centrifugal forces applied to it and in addition to the radial tensile forces exerted upon it by the rotor wheel disk which is rigidly connected to it, leads to an expansion of the shrink collar and accordingly to a reduced contact surface between the rotor and the shrink collar and a reduction in the normal stresses and the frictional engagement ensured thereby.

In the rotor wheel according to one embodiment of the invention, a circumferential groove 3 is formed directly at the back 2.2 of the rotor wheel in place of radius 2.4' by cutting the rotor wheel 2, e.g., with a lathe tool, after its primary shaping, for example, forging or casting. Accordingly, the circumferential groove 3 has side walls (on the left-hand side and on the right-hand side in FIG. 1) which are substantially perpendicular to the axis of rotation x of the rotor wheel 2 and a rounded groove base (at bottom in FIG. 1). The transition of the groove 3 into the radially outer lateral surface of the shrink collar 2.3 likewise has a radius to reduce notch effect and the risk of injury.

Figure 2:
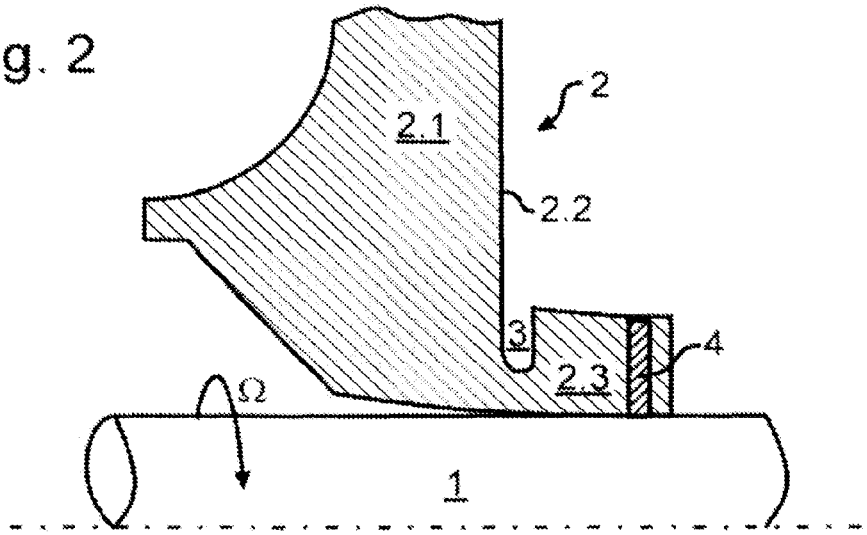
FIG. 2 is the rotor wheel according to FIG. 1 during operation.

In an exaggerated view, FIG. 2 shows the rotor wheel according to the invention during operation, i.e., during a rotation Ω around the axis of rotation x. The rotor wheel disk 2.1 in particular, whose outer diameter is larger owing to the rotor blades and is illustrated by the lifting up in the left-hand or front rotor wheel area, expands as a result of centrifugal forces. The centrifugal forces acting on the shrink collar 2.3 and radial tensile forces transmitted to it by the rotor wheel disk 2.1 also expand the shrink collar 2.3. However, due to the joint-like action of the circumferential groove 3 whose groove width (from left to right in FIG. 1) is essentially 0.25 times the entire axial length of the shrink collar from its right-hand face to the rear wall 2.2 and whose groove depth (from top to bottom in FIG. 1) is essentially 0.65 times the radial height of the shrink collar from its inner diameter to its outer diameter, the rotor wheel disk 2.1 exerts only a slight tilting moment or bending moment on the shrink collar 2.3 so that there is less of a reduction in the supporting shrink fit length thereof compared to conventional rotor wheels.

Accordingly, an improved shrink fit is achieved in operation as a result of the groove or necking 3. In particular, the shrink collar pins 4 arranged in the rear area are less stressed and safety is accordingly increased. Accordingly, a greater radial expansion at the front rotor wheel area (at left in FIG. 1) compared to conventional rotor wheels is negligible in comparison or is compensated by corresponding dimensioning of a seal diameter.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A rotor wheel for a turbomachine, comprising:

a rotor wheel face;

a shrink collar adjoining the rotor wheel face for shrinking onto a rotor of the turbomachine;

a circumferential groove between the rotor wheel face and the shrink collar; and at least one bore hole configured to receive a shrink collar pin, the bore hole arranged between the circumferential groove and a face of the shrink collar.

2. The rotor wheel according to claim 1, wherein the shrink collar is arranged at the rotor wheel face, which is a downstream rear wall of the rotor wheel.

3. The rotor wheel according to claim 1, wherein the shrink collar is constructed integral with a rotor wheel disk of the rotor wheel.

4. The rotor wheel according to claim 1, wherein the circumferential groove is formed at the rotor wheel face.

5. The rotor wheel according to claim 1, wherein the groove depth in radial direction is:

at least 0.1 times a radial height of the shrink collar; and at most 0.99 times a radial height of the shrink collar.

6. The rotor wheel according to claim 5, wherein the groove depth in radial direction is:

at least 0.3 times the radial height of the shrink collar; and at most 0.7 times the radial height of the shrink collar.

7. The rotor wheel according to claim 5, wherein the groove depth in radial direction is:

at least 0.5 times the radial height of the shrink collar; and at most 0.65 times the radial height of the shrink collar.

8. The rotor wheel according to claim 1, wherein the circumferential groove is rounded on at least one of its radially inner side and its radially outer side.

9. The rotor wheel according to claim 1, wherein the circumferential groove is produced by one or more of primary shaping, deformation, and cutting.

10. The rotor wheel according to claim 9, wherein the cutting is cutting with a lathe tool.

11. The rotor wheel according to claim 1, wherein the circumferential groove is stepped radially one or more times.

12. The rotor wheel according to claim 1, wherein the circumferential groove has one of a curved lateral surface and a lateral surface that is inclined with respect to an axis of rotation of the rotor.

13. The rotor wheel for a turbomachine according to claim 1, wherein the rotor wheel is a radial turbomachine.

14. A turbomachine, configured as a radial turbomachine, having a rotor wheel comprising:

a rotor wheel face;

a shrink collar adjoining the rotor wheel face for shrinking onto a rotor of the turbomachine;

a circumferential groove between the rotor wheel face and the shrink collar; and at least one bore hole configured to receive a shrink collar pin, the bore hole arranged between the circumferential groove and a face of the shrink collar.

15. A method for producing a rotor wheel comprising:

a rotor wheel face;

a shrink collar adjoining the rotor wheel face for shrinking onto a rotor of the turbomachine; and a circumferential groove between the rotor wheel face and the shrink collar, the method comprising:

forming the circumferential groove by cutting with a lathe tool; and inserting at least one shrink collar pin in a hole in the shrink collar.

* * * * *